United States Patent [19]

Dallmann et al.

[11] Patent Number: 5,048,281

[45] Date of Patent: Sep. 17, 1991

[54] PROCESS AND DEVICE FOR THE ADJUSTMENT OF AN AIR SPINNING DEVICE

[75] Inventors: Harald Dallmann, Winterthur, Switzerland; Peter Artzt; Gerhard Egbers, both of Reutlingen, Fed. Rep. of Germany

[73] Assignee: Schubert & Salzer Maschinenfabrik Aktiengesellschaft, Ingolstadt, Fed. Rep. of Germany

[21] Appl. No.: 424,397

[22] Filed: Oct. 20, 1989

[30] Foreign Application Priority Data

Oct. 26, 1988 [DE] Fed. Rep. of Germany ..... 3836481

[51] Int. Cl.[5] ..... D01H 1/115; D01H 13/20

[52] U.S. Cl. ..... 57/264; 57/328; 57/333

[58] Field of Search ..... 57/264, 265, 328, 333, 57/350

[56] References Cited

U.S. PATENT DOCUMENTS

| | | | |
|---|---|---|---|
| 3,807,159 | 4/1974 | Hamel | 57/264 X |
| 4,183,202 | 1/1980 | Morihashi | 57/328 |
| 4,399,648 | 8/1983 | Kato | 57/328 X |
| 4,718,225 | 1/1988 | Sanagi | 57/328 |
| 4,744,209 | 5/1988 | Wassenhoven | 57/263 X |
| 4,821,503 | 4/1989 | Stalder et al. | 57/333 X |
| 4,825,633 | 5/1989 | Artzt et al. | 57/333 X |

FOREIGN PATENT DOCUMENTS

| | | | |
|---|---|---|---|
| 2933782 | 3/1981 | Fed. Rep. of Germany | 57/264 |

*Primary Examiner*—Joseph J. Hail, III

*Attorney, Agent, or Firm*—Dority & Manning

[57] ABSTRACT

An air spinning device with an injection nozzle and a twisting nozzle is adjusted to the highest possible delivery speed for a desired yarn quality by predetermining the desired spinning tension of the yarn. According to the predetermined spinning tension, the highest possible delivery speed is regulated by changing the injection nozzle pressure and/or the spinning draft. Several spinning stations are installed on the air spinning device. At the spinning station, a measuring device to determine the yarn quality is installed between the twisting nozzle and the draw-off rollers. The measuring device is connected to adjusting devices of at least one spinning station. When the yarn quality is changed, the measuring device, together with the adjusting devices influences at least this spinning station.

8 Claims, 4 Drawing Sheets

[cN]
A
B
C
$V_{L1}$
$V_{L2}$

[cN]
C
B
A
max.
min.
$P_{IC}$
$v_C$
$P_{IA}$
$v_A$
$P_{IB}$
$v_B$
$V_{L1}$
$V_{L2}$ 2
31
3
32
1
5
4
F
$P_T$
33
$P_D$
34
$P_T$
21
$V_L$
42
V
6
cN
2 4 6 8 10 12 14 16 18
-
+

PROCESS AND DEVICE FOR THE ADJUSTMENT OF AN AIR SPINNING DEVICE

BACKGROUND OF THE INVENTION

The instant invention relates to a process for the adjustment of an air spinning device, with an injection nozzle and a twisting nozzle, to the highest possible delivery speed for a desired yarn quality, as well as to an air spinning device with several spinning stations to carry out the process.

It is known that properties of a yarn spun on an air spinning machine can be supervised by means of the spinning tension of the yarn produced.

It is, furthermore, known that yarn properties can be influenced by a modification of the air pressure at the air spinning nozzles, by the spinning draft as well as by the delivery speed.

Adjustment of the air spinning machine, to achieve usable yarn values, have been effected in the past to conform to values which lie on the safe side for the production of a given yarn quality, it being, however, not always the case that optimal productivity is achieved. This has a negative effect, especially in spinning material of a new type or when the spinning conditions change due to wear of the spinning device.

SUMMARY OF THE INVENTION

It is, therefore, the object of the instant invention to provide a process and a device by means of which yarn (at a previously determined spinning tension) is produced at the highest possible delivery speed, i.e., with optimal productivity, whereby the spinning tension is a characteristic of the yarn quality.

This object is attained by measuring the desired yarn quality by means of a predetermined spinning tension of the yarn and by adjusting this predetermined spinning tension to the highest possible delivery speed by adjusting the injection nozzle pressure and/or the spinning draft. At the spinning station a measuring device is installed between the twisting nozzles and the draw-off rollers to record the yarn quality in order to achieve this object. The measuring device is connected to the adjusting devices of at least the spinning station upon which it exerts an influence when the yarn quality is changed.

In an advantageous further development of the process, and to achieve a desired yarn quality at the highest possible delivery speed, a predetermined range of spinning tension is observed. At the beginning of the spinning process the delivery speed is increased, whereby the spinning tension reaches a maximum value and then drops again. Upon reaching of the maximum value when the predetermined range of the spinning tension is not attained, the delivery speed is maintained and the injection nozzle pressure and/or the spinning draft is modified to such an extent that the spinning tension returns to within the predetermined range. Subsequently the delivery speed is again increased until the spinning tension can be regulated within the predetermined range.

BRIEF DESCRIPTION OF THE DRAWINGS

An embodiment of the invention described through the following illustrations where.

DETAILED DESCRIPTION OF THE INVENTION

Spinning draft is understood to be the yarn tension ascertained in the yarn running direction, directly before the pair of draw-off rollers during the production of the yarn. Spinning draft is the draft in the spinning zone, i.e., between the output of the drafting equipment and the pair of draw-off rollers. It is calculated on basis of the quotient of the draw-off roller speed and the speed at the output of the drafting equipment, and is less than 1.

The quality of the yarn is characterized by its toughness, its flexural strength, nappiness, volume and deformability. Depending upon the application of the yarn, e.g., knitting yarn or weaving yarn, a certain yarn quality is required.

The required yarn quality should be produced with optimal productivity, i.e., at the highest possible delivery speed. This has limits, however, since the toughness of the yarn drops when a certain high delivery speed is reached. The reason for this is that twist decreases, and with it the spinning tension also drops. Since the toughness of the yarn is directly proportional to the spinning tension, it can be indicated by the spinning tension in the production of the yarn. The spinning tension, is thereby, also a characteristic of the yarn quality.

This decrease in spinning tension, when the delivery speed increases, is counteracted by decreasing the injector nozzle pressure $P_I$ and/or by increasing the spinning draft. The decision as to which should preferably be changed, the injector nozzle pressure $P_I$ or the spinning draft, depends on the fiber material to be spun and on the desired yarn quality. With a fiber having great elongation, as well as for the production of weaving yarn, the spinning draft v is increased first. With a fiber having little elongation, as well as for the production of knitting yarn, the injector nozzle pressure $P_I$ is preferably decreased first.

Figure 1:
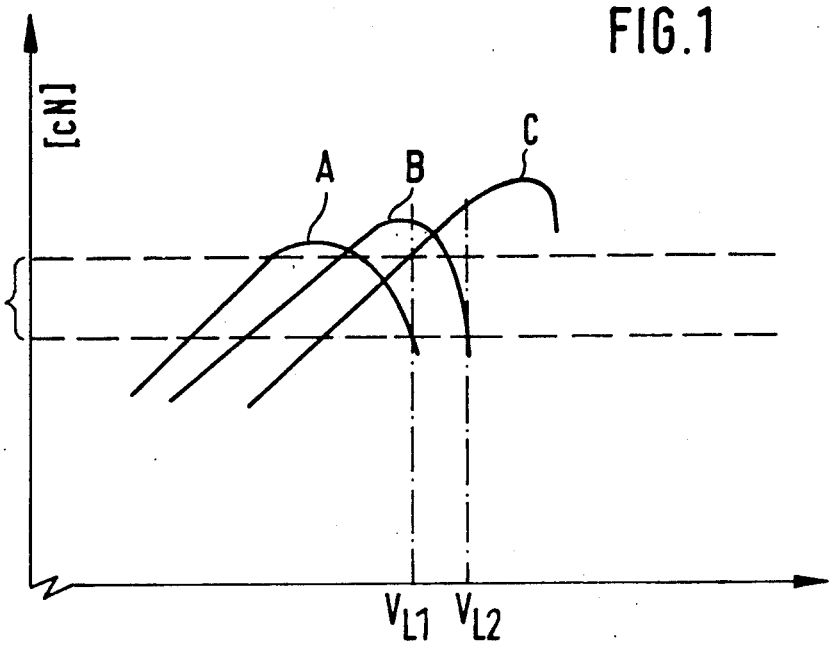
FIG. 1 is a diagram of the interdependencies of the delivery speed, spinning tension, nozzle pressure and the spinning draft.
Figure 2:
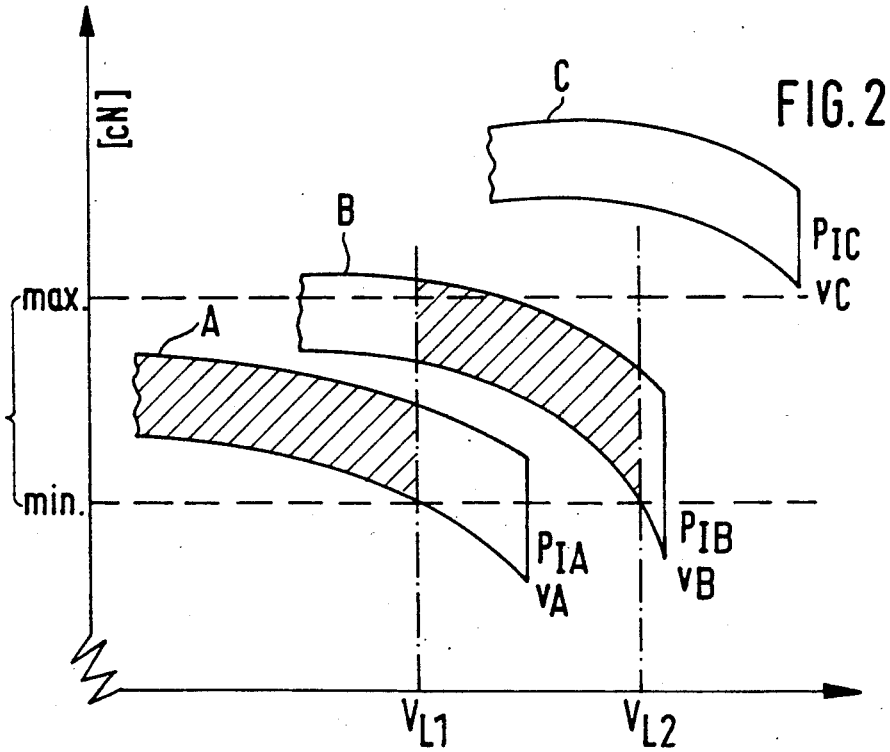
FIG. 2 is a sectional view of the diagram of FIG. 1.

FIGS. 1 and 2 show a schematic diagram in which the spinning tension is imparted through the delivery speed $V_L$. The curves A, B and C represent the course of the spinning tension for a given fiber material at the different settings $P_{IA}$, $V_A$, $P_{IB}$, $V_B$, $P_{IC}$, $V_C$. The curves A, B and C can have different slopes and/or culmination points for different fiber materials.

Since it is not known along which curve, e.g., A, B or C optimal productivity can be attained when a new fiber material is used or when there are changes of spinning conditions on the air spinning device such as wear of the draw-off rollers, wear or displacement of the spinning nozzles 3 or of the drafting equipment, a change of the parameters injection nozzle air pressure $P_I$ or the spinning draft causes a jump from curve A to the next curve B. The manner of proceeding is such that when the delivery speed $V_L$ increases a maximum of spinning tension is achieved, whereupon the spinning tension decreases once more. If the spinning tension at $V_{L1}$ drops below the previously selected minimum desired spinning tension value, a change of the injector nozzle air pressure $P_{IA}$ and/or of the spinning draft $V_A$ causes a jump into curve B, with an injector nozzle pressure $P_{IB}$ and a spinning draft $V_B$. Depending on the change, $P_{IA}$ and $P_{IB}$ or $V_A$ and $V_B$ can be identical.

Following a jump into curve B, the procedure is similar as at the beginning of curve A. When the culmination point of curve B has been passed, the spinning tension drops again at delivery speed $V_{L2}$ below the desired minimum value while the delivery speed $V_L$ increases. After a change of the spinning parameters as described above, a jump is made into curve C in which the same procedure is followed. It can be seen from curve C that the maximum desired spinning tension value is no longer reached after the culmination point since the fibers, for example, tear at a higher speed and can, therefore, no longer be spun. It is, therefore, not possible to increase the delivery speed $V_L$ to achieve the desired yarn quality in the previously determined range of spinning tension.

In FIG. 2, the curves A, B and C of FIG. 1 are enlarged. The curves A, B and C are to be understood to indicate a range in which the spinning tension is contained while a certain delivery speed $V_L$ applies. The desired range of the spinning tension is indicated on the axis of the spinning tension. It is changed with the different desired yarn qualities to be produced. For example, the desired range is between 8 and 12 cN when a weaving yarn is produced, while the range extends from 4 to 8 cN for the production of knitting yarn. The different ranges can, of course, be further restricted in order to produce a yarn with low quality variations. In weaving yarn, a range between 8 and 10 cN will be better suited for the warp thread, and a range between 10 and 12 cN for the weft thread.

The curves A and B in FIG. 2 show a section of the curves A and B of FIG. 1 starting at the culmination point. As can be seen, when the delivery speed $V_L$ is increased, the curve A drops to within the desired spinning tension range until it has reached the minimum desired spinning tension. This occurs at the delivery speed $V_{L1}$. If the parameters injector nozzle pressure $P_{IA}$ and/or spinning draft $V_A$ are now changed to the values $P_{IB}$ and $V_B$, a jump into curve B is achieved, whereby the maximum desired spinning tension is easily exceeded. A further increase of the delivery speed $V_L$ to the point $V_{L2}$ causes a drop of spinning tension to within the desired spinning tension range. An increase of the delivery speed $V_L$ from $V_{L1}$ to $V_{L2}$ was thus possible, with the yarn produced being of the same quality as at the lower delivery speed. A further change of the injector nozzle pressure $P_{IB}$ and/or of the spinning delay $V_B$ causes a jump into curve C to occur. As can be seen, an increase of the delivery speed $V_L$ with the parameters of the curve C would not be below the highest desired spinning tension value, since the fiber cannot be spun before. This means that the desired yarn quality cannot be achieved with the curve C at an increased delivery speed $V_L$. It is, therefore, necessary to return to the values of curve B.

Figure 3:
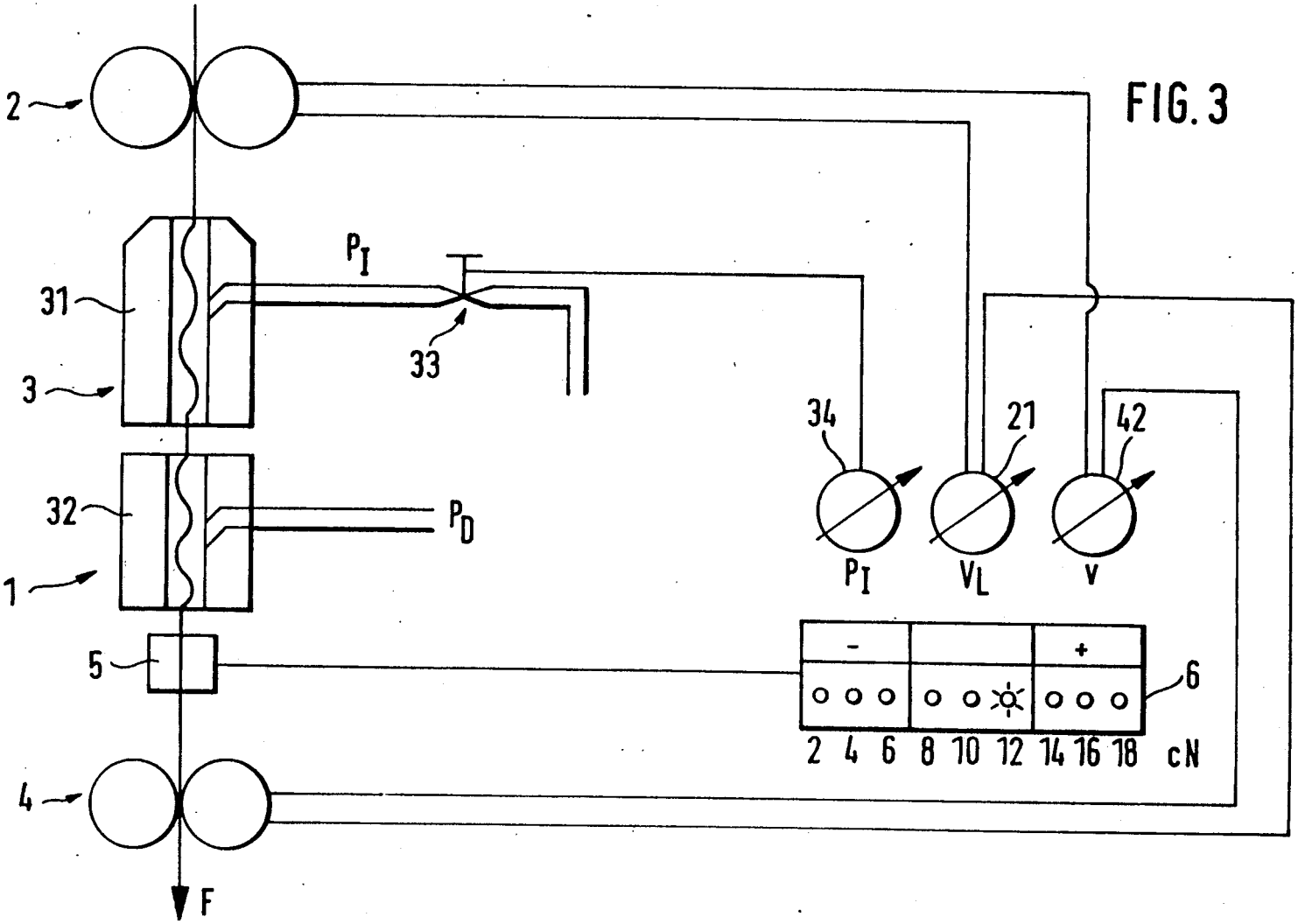
FIG. 3 is a diagrammatic view of an air spinning device in schematic representation for the setting of delivery speed, nozzle pressure and spinning draft.

FIG. 3 shows an air spinning station 1 with high draft rollers 2 of known drafting equipment which is, therefore, not shown. A system consists of spinning nozzles 3 and draw-off rollers 4. The spinning nozzles 3 consist of an injection nozzle 31 and a twisting nozzle 32. A yarn F is given a twist in the spinning nozzles 3, with the twisting effect of the injector nozzle 31 acting against the effect of the twisting nozzle 32. A nozzle pressure $P_D$, which is greater than an injector nozzle pressure $P_I$ at the injection nozzle, is applied at the twisting nozzle 32. The twisting nozzle pressure $P_D$ is set to be constant in order to achieve optimal spinning conditions.

The injector nozzle pressure $P_I$ is adjustable via a valve 33. The valve 33 can be adjusted via a pressure adjusting device 34. By increasing or lowering the injection nozzle pressure $P_I$ via valve 33, and by means of the pressure adjusting device 34, a change in spinning tension is achieved. The spinning tension is measured via spinning tension measuring detector 5. The spinning tension measuring detector 5 is located between the twisting nozzle 32 and the draw-off rollers 4. This makes it possible to measure the spinning tension of the yarn F which has just been produced. The measuring detector 5 transmits its signal, in this embodiment, to a display 6. This analog or digital display indicates whether the spinning tension of the yarn being produced lies within the previously selected tolerance range. It is advantageous for an indication of the desired spinning tension range, which can also be adjusted according to the desired spinning tension, to be shown on the display 6. The display 6 clearly shows whether the spinning tension lies within the previously indicated desired range.

In the present embodiment, the display of the prevailing spinning tension is effected via a diode strip in which each diode corresponds to its assigned spinning tension range. By overlaying the diode strip with a mask indicating the desired range of the spinning tension and the upward (+) or downward (−) deviations, the operator can quickly recognize whether spinning takes place within the desired spinning range. It would, however, be also possible to effect this indication on a display instrument with a needle, in which an overlaid mask over the needle instrument shows the desired range of the spinning tension. If the mask is installed in a mobile manner on the display device 6 it is easy for the operator to set the mask to the new desired value in case of a change in the yarn quality to be produced is tied to a change of the desired range of spinning tension.

If the display 6 shows that the spinning tension lies outside the desired range, it is possible, on the one hand, to mover the spinning tension back into the desired range by means of the pressure adjusting device 34 and the valve 33. Another means of bringing the spinning tension back into its desired range consists in changing the spinning draft via an adjusting device 42. The adjusting device 42 acts upon the drive of the draw-off rollers 4 and/or of the drafting equipment 2 and changes their speed. If the speed of the draw-off rollers 4 increases, for instance, the spinning draft also changes. This is, of course, on the condition that the other parameters such as delivery speed $V_L$ and injection nozzle pressure $P_I$ do not, in turn, act against the change of the spinning draft.

An adjusting device 21 serves to change the delivery speed $V_L$. This makes it possible to increase the delivery speed $V_L$ and, thereby, to attain the maximum delivery speed $V_L$ possible to achieve a given yarn quality. The adjusting device 21 acts upon the drive of the drafting equipment and influences the speed of the high draft rollers 2.

Figure 5:
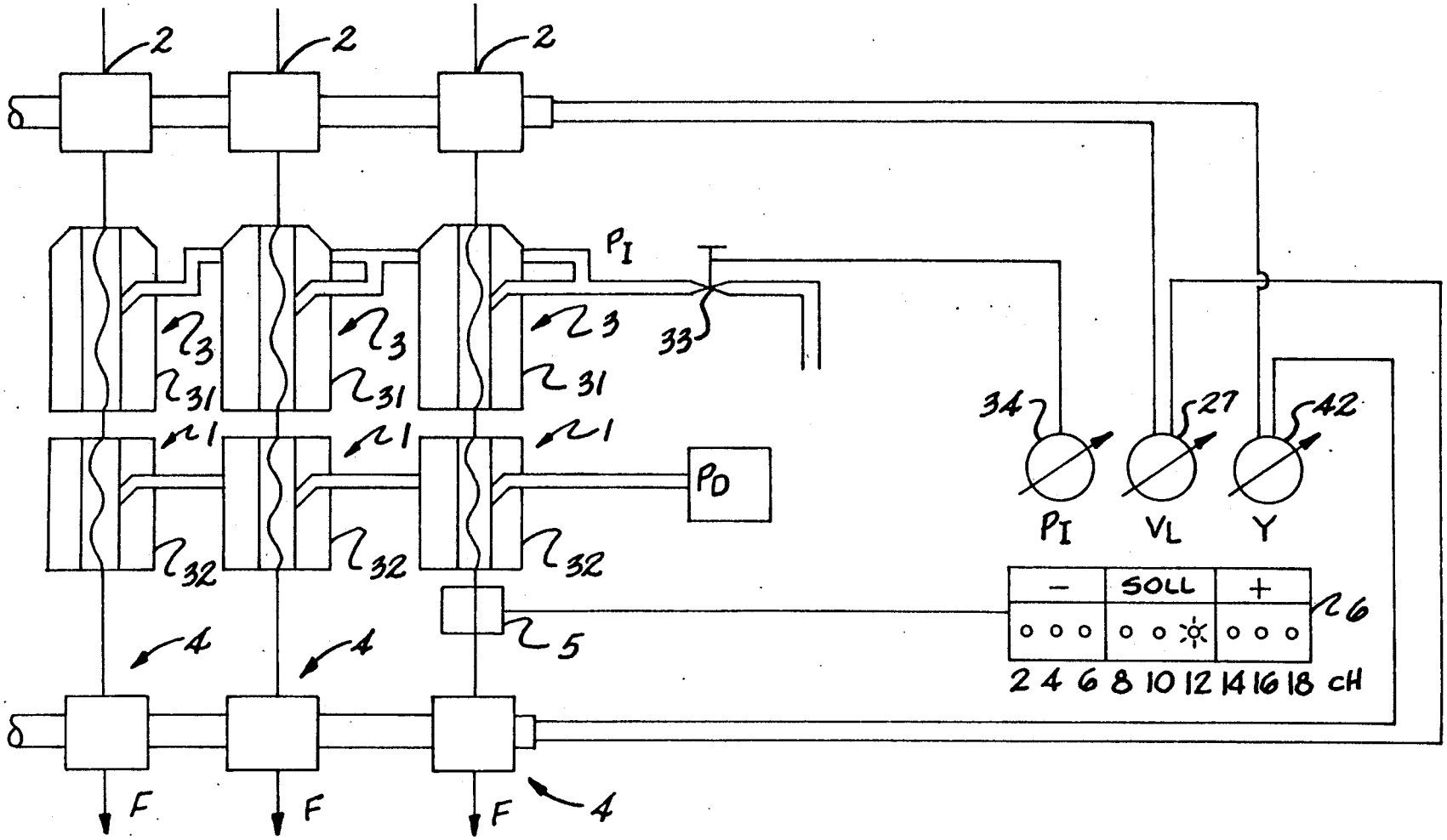
FIG. 5 is a diagrammatic view of an air spinning device having a plurality of spinning stations.

In another embodiment, as seen in FIG. 5, the adjusting devices 21, 34 and 42 not only act upon the spinning station 1 where the spinning tension measuring detector 5 is installed, but also upon other spinning stations where the same fiber material is being spun and where the same spinning conditions prevail as at the spinning station 1. The principle used here is that the different spinning stations do not deviate significantly from each other, so that it suffices to measure the spinning tension at only one spinning station. If the desired range of the spinning tension to be set is reduced by comparison with the maximum desired range, yarn of the required quality is also produced at spinning stations where the spinning tension is not measured, since the possible deviations from the restricted desired range are still within the maximum desired range.

If the spinning tension measuring detectors 5 are also installed at the other spinning stations, with their displays 6 being installed at a central location, a very precise supervision of all the spinning stations is made possible. If the adjusting devices 21, 34 and 42 continue to act together upon several spinning stations 1 it is possible to select the setting of the injection nozzle pressure $P_I$, of the delivery speed $V_L$ and of the spinning draft v so that all the spinning stations will have a spinning tension lying within the desired range.

The most precise possible setting of the spinning tension for all spinning stations of a spinning device is made possible if each individual spinning station 1 is provided with a display device 6 as well as with adjusting devices 21, 34, 42.

This embodiment ensures individual adjustment of each spinning station to the optimal spinning tension range for the desired yarn quality at the highest possible delivery speed $V_L$. The deviations of the desired spinning tension at a spinning station 1 can be detected immediately and can be corrected independently of the other spinning stations 1 whose spinning tension is still within the required range.

Figure 4:
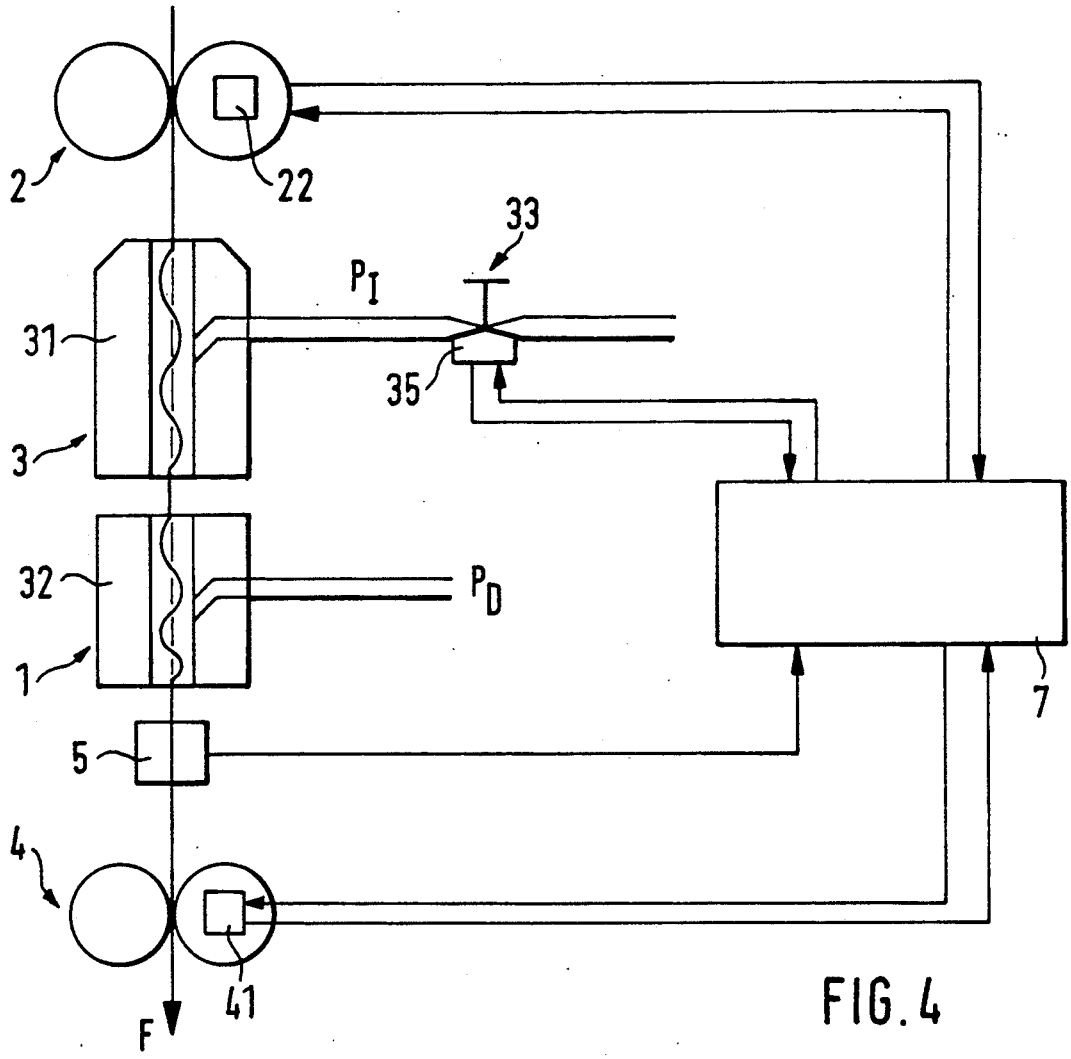
FIG. 4 is a diagrammatical view of an air spinning device for the regulation and control of delivery speed, nozzle pressure and spinning draft.

FIG. 4 shows a spinning device 1 in which measuring devices 22, 35 and 41 are installed at the high draft rollers 2, at the valve 33, and at the draw-off rollers 4. These measuring devices 22, 35 and 41 transmit the actual state of the delivery speed $V_L$, of the injection nozzle pressure $P_I$ as well as of the spinning draft v to a regulating and control unit 7. The regulating and control unit 7, furthermore, evaluates the actual state of the spinning tension which it receives from the spinning tension measuring detector 5. A comparison between this spinning tension and the previously set desired spinning tension makes it possible for the regulating and control unit 7 to influence the delivery speed $V_L$, the injection nozzle pressure $P_I$ and/or the tensing draft v. Prior input of the desired yarn quality, i.e., whether the yarn is to be used as a knitting or weaving yarn, as well as of the fiber elongation and the toughness of the yarn to be produced enables the regulating and control unit to decide which parameters are to be adjusted preferably to increase productivity, i.e., to achieve the highest possible delivery speed.

With knitting yarns, fibers with little elongation, and a thinner yarn it will be preferred to strive for an increase of delivery speed through a reduction of the injection nozzle pressure $P_I$ while maintaining the yarn quality. With weaving yarn and fibers with great elongation, on the other hand, as well as with thicker yarn, an attempt will preferably be made to increase the spinning draft v. In any case, it should be noted that the desired spinning tension depends on the yarn quality but not on the yarn thickness. This means that thick and thin yarn of identical quality are spun with identical spinning tension.

Here, too, the connection of the regulating and control unit 7 to several spinning stations on which it acts is possible. Furthermore, it may be advantageous for the measuring devices 22, 35 and 41 of the embodiment of FIG. 4 to be used in an embodiment of FIG. 3. By displaying the actual values of the delivery speed $V_L$, of the injection nozzle pressure $P_I$, and of the spinning draft v, a better adjustment of these values is possible since they allow for an orientation, whether or not a parameter is already close to its maximum possible value, or whether or not greater changes can be made in this parameter.

We claim:

1. An air spinning device comprising a plurality of spinning stations for air spinning yarn, at least one of said stations comprising:

(a) a plurality of drafting rollers for drafting textile fiber for forming a spun yarn;

(b) an injection air nozzle for engaging said spun yarn after it emerges from said drafting rollers;

(c) a twister air nozzle for engaging and twisting said spun yarn after it emerges from said injector nozzle;

(d) tension measuring means for detecting and measuring the tension level in said spun yarn after it emerges from said twisting nozzle and for generating a signal corresponding to the tension level detected;

(e) first pressure means for maintaining the air pressure in said twisting nozzle at a constant level selected for the optimal spinning of said spun yarn;

(f) second adjustable pressure means for adjusting the air pressure level in said injector nozzle at a pressure level which is always below the constant pressure level of said twisting nozzle;

(g) draw-off rollers for drawing off said spun yarn emerging from said yarn measuring means; and (h) control means for receiving signals generated by said tension measuring means and for controlling the air pressure level in said injector nozzle and the speeds of said drafting rollers and said draw-off rollers to maintain the tension level in said yarn at a predetermined level.

2. An air spinning device as set forth in claim 1, wherein said yarn tension is controlled by said control means adjusting the speed of said drafting rollers.

3. An air spinning device as set forth in claim 1, wherein said control device controls the tension in said yarn by adjusting the air pressure in said injector nozzle.

4. An air jet spinning device as set forth in claim 1, wherein said tension measuring means comprises display means for displaying deviations in said yarn tension from a preselected range.

5. An air spinning device as set forth in claim 4, including means to show the direction of deviation from said preselected tension level on said display means.

6. An air spinning device as set forth in claim 4, wherein said display means comprises means for adjusting the desired tension range.

7. An air spinning device as set forth in claim 1, including means for adjusting the spinning draft and said injection nozzle air pressure level automatically.

8. An air spinning device as set forth in claim 1, wherein said spinning draft, delivery speed, and the injection nozzle air pressure level are adjusted by said control means to maintain said yarn at the desired quality level.

* * * * *